United States Patent [19]

Lechner et al.

[11] 4,057,142

[45] Nov. 8, 1977

[54] PACKAGING OF SEMICONDUCTOR DISCS

[75] Inventors: Günther Lechner; Karl Pritscher; Helmut Kirschner, all of Burghausen, Germany

[73] Assignee: Wacker-Chemitronic Gesellschaft fur Elektronik-Grundstoffe mbH, Burghausen, Germany

[21] Appl. No.: 708,458

[22] Filed: July 26, 1976

[30] Foreign Application Priority Data

July 30, 1975 Germany ..... 2534074

[51] Int. Cl.[2] ..... B65D 21/02; B65D 65/16; B65D 81/16; B65D 85/30

[52] U.S. Cl. ..... 206/332; 206/497; 206/505; 206/515; 206/564

[58] Field of Search ..... 206/332, 328, 503, 505, 206/515, 516, 72, 309, 303, .82, .83, .84, 497, 564; 220/93

[56] References Cited

U.S. PATENT DOCUMENTS

| | | | |
|---|---|---|---|
| 3,069,001 | 12/1962 | Burdick | 206/.83 |
| 3,469,686 | 9/1969 | Gutsche et al. | 206/332 |
| 3,552,548 | 1/1971 | Wallestad | 220/93 |
| 3,661,253 | 5/1972 | Cronkhite | 206/332 |
| 3,672,495 | 6/1972 | Bauer et al. | 206/328 |
| 3,681,092 | 8/1972 | Titchenal et al. | 206/497 |
| 3,715,218 | 2/1973 | Feely | 206/72 |
| 3,719,273 | 3/1973 | Abe | 206/328 |
| 3,946,864 | 3/1976 | Hutson | 206/515 |

*Primary Examiner*—William T. Dixson, Jr.
*Attorney, Agent, or Firm*—Allison C. Collard

[57] ABSTRACT

A stackable plastics pallet for packaging semiconductor discs on a gas-tight foil covering, said pallet having a plurality of circular depressions each for accommodating a semiconductor disc, and means for securing the discs between the pallets, the securing means being in the form of sloping part-sector shaped surfaces surrounding said depressions, with two opposite sets of sloping surfaces clamping the semiconductor discs at their outermost rims and immobilizing them thereby.

5 Claims, 3 Drawing Figures

PACKAGING OF SEMICONDUCTOR DISCS

The present invention relates to packaging of semiconductor discs.

The packaging of semiconductor discs can present great difficulties, especially in view of the ever greater demands being made on semiconductor materials, which are very sensitive and have to be extremely pure. The discs are brittle and have to be protected against mechanical stress which may cause them to crack or break. They also have to be protected against contamination by packaging material rubbing off onto the discs, as well as against contamination by dust and atmospheric moisture.

Various types of packaging for semiconductor discs have been developed in attempts to meet these requirements. In one type of packaging, contact between the packaging material and the discs is restricted to the edge of the discs. This might seem to avoid contact of the packaging material with the polished main disc surfaces, but it is found that the polished surfaces can still become contaminated by abraded particles of packaging material.

Another type of packaging consists of deep-drawn plastics pallets in which the discs are held in position between the upper side of one pallet and the lower side of another pallet stacked on top of the first pallet. Knobs, tongue and groove joints, or like means can be provided to prevent relative displacement of the several pallets. The surfaces of the packaging material that bear on the semiconductor discs in these pallets are so-called "supporting rings" with a relatively large bearing surface. This results in the bearing pressure being fairly small with the consequence that shaking of the stacked pallets, for example during transit, could result in the discs rubbing against the packaging and producing abraded particles which contaminate the discs. Before further treatment and processing, the discs therefore have to be subjected to an expensive cleaning operation to restore them to their former flawless state.

It is the object of the present invention to provide for packaging of semiconductor discs which avoids the above-mentioned shortcomings and guarantees against contamination of the pure, flawless discs during handling and transportation.

This object is accomplished according to the invention by providing a stackable plastics pallet for packaging semiconductor discs in a gas-tight foil covering, the pallet having a plurality of circular depressions, each for accommodating a semiconductor disc, and means for securing the discs between the pallets, the securing means being in the form of sloping part-sector shaped surfaces surrounding the depressions, with two opposite sets of sloping surfaces clamping the semiconductor discs at their outermost rims and immobilizing them thereby.

More particularly, the bottom inner surface of each depression is so shaped that there are a plurality of partsector shaped surfaces on which the disc can rest, the surfaces sloping upward and downward toward the center of the depression in such a manner that when one pallet is stacked on top of another, the semiconductor disc contained in a depression of the lower pallet can be clamped between the downward-sloping surfaces surrounding the depressions of the lower pallet and the upward sloping surfaces surrounding the depressions of the upper pallet, the semiconductor disc being immobilized thereby. A more detailed description of the arrangement will be given later with reference to the accompanying drawing.

The diameter of the depressions will generally be tailored according to the diameter of the semiconductor discs to be contained therein and all the depressions in any one pallet will generally be of identical size, but different pallets may have different size depressions for accommodating different size discs. When discs are accommodated in pallets designed for that size of disc and the pallets are stacked one on top of another, only the extreme edges of the main surfaces of the discs will be in contact with the said upward-sloping and downward-sloping surfaces.

The stack of pallets is contained within a protective gas-tight bag, consisting of low permeability for gas, air and humidity in order to prevent contamination by dust, moisture and other outside influences. The bag will preferably be evacuated and then hermetically sealed around the stack, so as to prevent any inflation or destruction of the bag, for example during air transport with a reduced external pressure.

In many cases, atmospheric pressure on the outside of the protective bag will be sufficient to maintain the stack firm and prevent any movement of the pallets relative one to another. In other cases, however, for example when the atmospheric pressure is substantially reduced, such as during transport in an aeroplane, additional pressure may be necessary to maintain the stack firm. Such additional pressure may conveniently be the tension of a shrinkable film shrunk around the stack: either a film may be shrunk around the protective bag after it has been sealed or the bag itself may be of a shrinkable film material and may be shrunk around the stack prior to being sealed.

The arrangement of the upward-sloping surfaces and the downward-sloping surfaces is advantageously such that one pallet can be stacked on top of another substantially identical pallet in such a way that all the downward-sloping surfaces of the lower pallet are immediately below the upward sloping surfaces of the upper pallet. In order to obtain this desired relative position of the two pallets, one pallet will, in the case of rectangular pallets, have to be turned through 180° in the horizontal plane relative to the other pallet.

When the pallets in a stack of two or more pallets are so arranged that the downward-sloping surfaces of one pallet are immediately below the upward-sloping surfaces of the pallet immediately above, the upward and downward forces on semiconductor discs contained within the lower of the two pallets are so balanced as not to exert uneven pressure on the disc which may tend to cause it to break or become cracked.

Advantageously, the bottom of each depression is so shaped that there is a central substantially horizontal circular portion with the upward-sloping surfaces and the downward-sloping surfaces extending outward therefrom.

From 10 up to 200 semiconductor discs may be accommodated in a stack of pallets according to the invention, each pallet containing one disc in each depression, apart from the uppermost pallet which would be empty. The discs may be, for example, lapped, polished or epitaxial semiconductor discs.

One form of pallet according to the invention will now be described, by way of example only, with reference to the accompanying drawings, in which FIG. 1 is a top plan view of a pallet;

Figure 1:
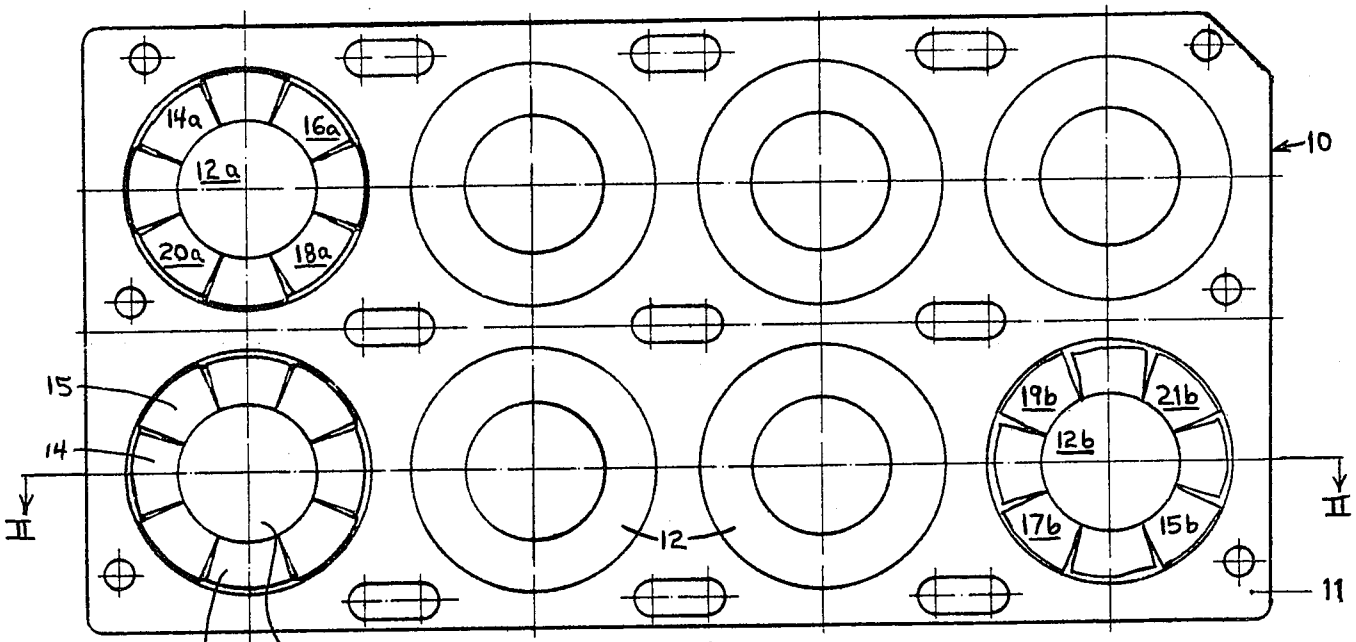
Figure 2:
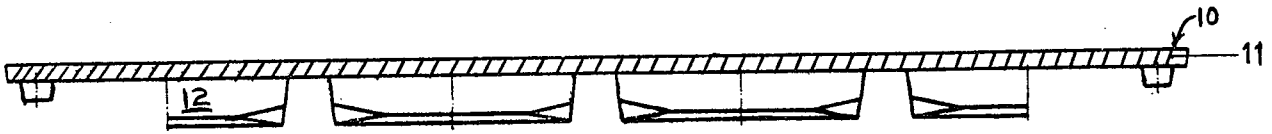
FIG. 2 is a view partly in section taken along line II—II of FIG. 1.
Figure 3:
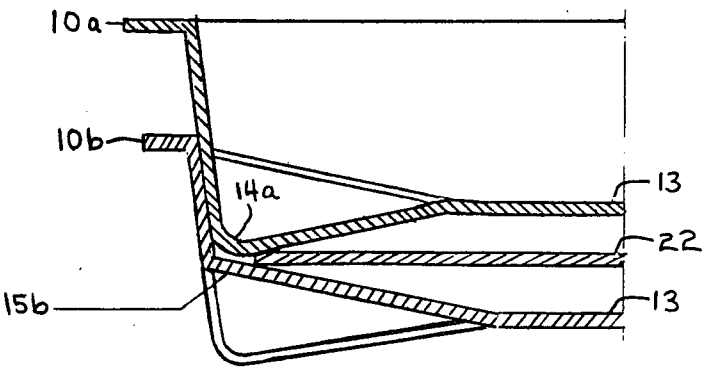
FIG. 3 is an enlarged cross-sectional view of a section of two pallets stacked one above the other with a semiconductor disc contained in the lower pallet.

A deep-drawn plastics pallet 10 has a rectangular and substantially planar surface 11 with eight substantially circular depressions 12, each for containing a semiconductor disc. The bottom of each depression 12 has a central substantiably horizontal circular portion 13 and has eight partsector surfaces 14 and 15 sloping alternatively upward 14 and downward 15 toward the central circular portion 13. The arrangement of the sloping surfaces 14 and 15 is such that when one pallet is stacked on top of and turned through 180° relative to another identical pallet, such that, for example, depression **12*a* in the upper pallet is immediately above depression 12*b* in the lower pallet, the upward-sloping surfaces, such as surfaces 14*a*, 16*a*, 18*a* and 20*a*, in the upper pallet are immediately above the downward-sloping surfaces, such as surfaces 15*b*, 17*b*, 19*b* and 21*b* respectively in the lower pallet. As may clearly be seen in FIG. 3, a semiconductor disc 22 contained within the lower pallet 10*b* can be clamped at the extreme edges of its main surface between the downward-sloping surfaces, such as surfaces 15*b*, of the lower pallet 10*b* and the upward-sloping surfaces, such as surface 14*a*, of the upper pallet 10*a***.

When a stack of pallets according to the invention containing semiconductor discs is properly sealed in a protective bag and transported, there is generally substantially no abrasion between the discs and the pallets and, despite contact between the pallets and the discs, no packaging material is transferred to the discs. Thus, after being transported, the semiconductor discs are not generally contaminated by packaging material and there is no need for an expensive or laborious cleaning operation using, for example, high-purity solvents, before they are further processed, although care has, of course, to be taken in removing the discs from the pallets.

While only a few embodiments of the present invention have been shown and described, it will be obvious to those skilled in the art that many changes and modifications may be made thereunto without departing from the spirit and scope of the invention.

What is claimed is:

1. A stackable plastic pallet assembly for packing semiconductor discs in a vertically-disposed stack of substantially identical pallets, comprising:

at least one stackable plastic pallet having a plurality of circular depressions, each of which may accommodate a semiconductor disc and means for releasably securing the discs in said depressions, said means comprising a plurality of part sector-shaped surfaces which surround and slope downwardly toward the center of said depressions on which the outermost rims of the discs may rest and a plurality of part sector-shaped surfaces which surround and slope upwardly toward the center of said depressions and which, upon stacking of said at least one pallet in a vertically-disposed stack of substantially identical pallets, cooperate with the downwardly sloping part sector-shaped surfaces of the pallet therebelow to clamp the outermost rims of the discs contained in the depressions of the lowermost pallet therebetween, thereby immobilizing the discs.

2. The assembly as recited in claim 1, wherein said pallet has a generally planar surface in which said depressions and said part sector shaped-surfaces are formed and wherein said assembly includes at least two stackable pallets which are arranged in a vertically disposed stack such that all of the downwardly sloped surfaces of the lower pallet are disposed immediately below the upwardly sloped surfaces of the upper pallet.

3. The assembly as recited in claim 2 additionally including a plurality of semiconductor discs, each of which is inserted in one of the depressions of at least the lower pallet and a gas-tight foil covering which encloses said stack and which comprises a bag which is evacuated and hermetically sealed whereby the clamping force exerted by the cooperating upwardly sloped surfaces of the upper pallet and the downwardly sloped surfaces of the lower pallet for immobilizing the semiconductor discs therebetween is increased by the atmospheric pressure bearing on the bag from the outside.

4. The assembly as recited in claim 3, wherein said bag comprises a pre-shrunk film.

5. The assembly as recited in claim 3 additionally including a shrinkable film which has been shrunk around the sealed bag.

* * * * *